US005473916A

United States Patent [19]

Ye

[11] Patent Number: 5,473,916

[45] Date of Patent: Dec. 12, 1995

[54] PULSATOR FOR WASHING MACHINE

[75] Inventor: Byeong-Seol Ye, Suwon, Rep. of Korea

[73] Assignee: Samsung Electronics Co., Ltd., Suwon, Rep. of Korea

[21] Appl. No.: 264,975

[22] Filed: Jun. 24, 1994

[30] Foreign Application Priority Data

| | | | |
|---|---|---|---|
| Jun. 25, 1993 | [KR] | Rep. of Korea | 1993-11321 |
| Jun. 25, 1993 | [KR] | Rep. of Korea | 1993-11322 |
| Jun. 25, 1993 | [KR] | Rep. of Korea | 1993-11323 |

[51] Int. Cl.[6] ..... D06F 17/10

[52] U.S. Cl. ..... 68/134

[58] Field of Search ..... 68/23.6, 23.7, 68/133, 134; 366/276, 278

[56] References Cited

U.S. PATENT DOCUMENTS

| | | | |
|---|---|---|---|
| 1,729,751 | 10/1929 | Snyder | 68/133 |
| 2,192,758 | 3/1940 | Skinner | 68/133 X |
| 2,289,419 | 7/1942 | Garubo | 68/133 |
| 2,416,611 | 2/1947 | Castricone | 68/134 X |
| 4,434,630 | 3/1984 | Ikeda | 68/23.6 X |
| 4,594,863 | 6/1986 | Oida | 68/134 X |

FOREIGN PATENT DOCUMENTS

| | | | |
|---|---|---|---|
| 1159679 | 2/1958 | France | 68/23.6 |
| 1017586 | 10/1957 | Germany | 68/133 |

*Primary Examiner*—Philip R. Coe

*Attorney, Agent, or Firm*—Burns, Doane, Swecker & Mathis

[57] ABSTRACT

An agitator for a washing machine includes a base, an agitating post extending eccentrically upwardly from the base, and agitating blades upstanding from the base. An upper surface of the agitating post is inclined with respect to horizontal by an angle up to 75 degrees. The blades extend radially in circumferentially spaced relationship around the entire base. Alternatively, the blades could extend parallel to one another on only one half of the base, the other half including an upward protrusion extending circumferentially at a location adjacent an outer periphery of that other half.

11 Claims, 6 Drawing Sheets

FIG. 3
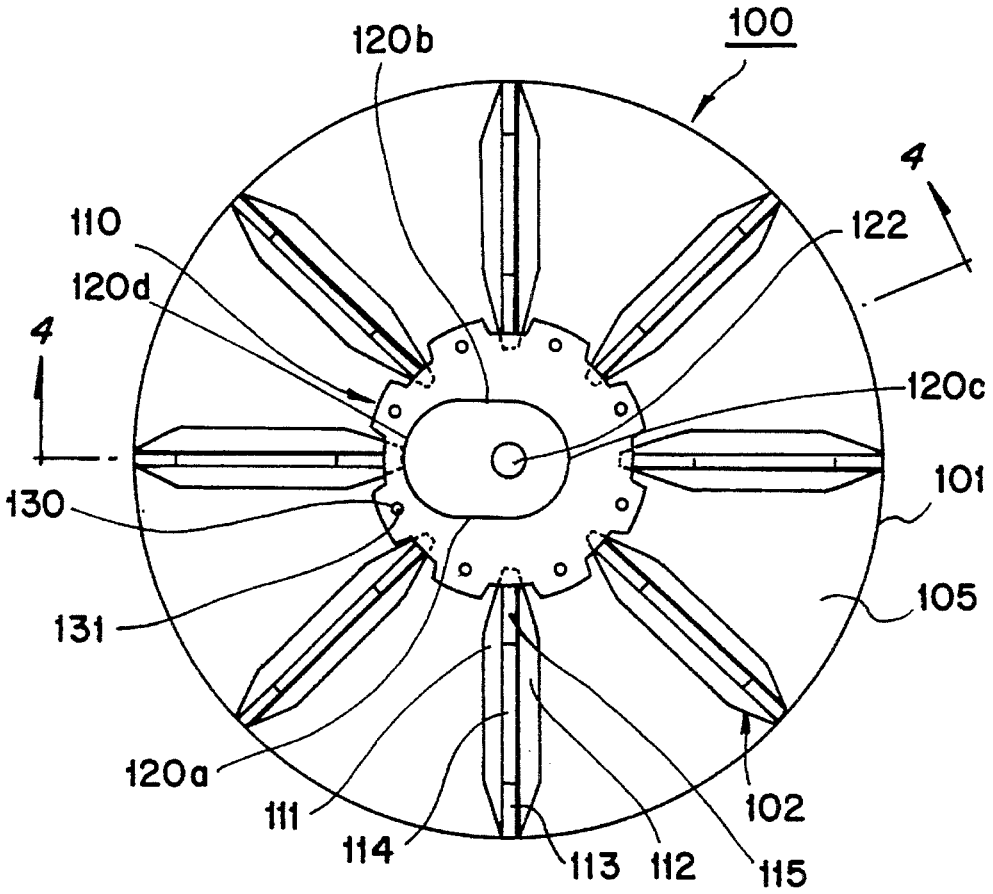
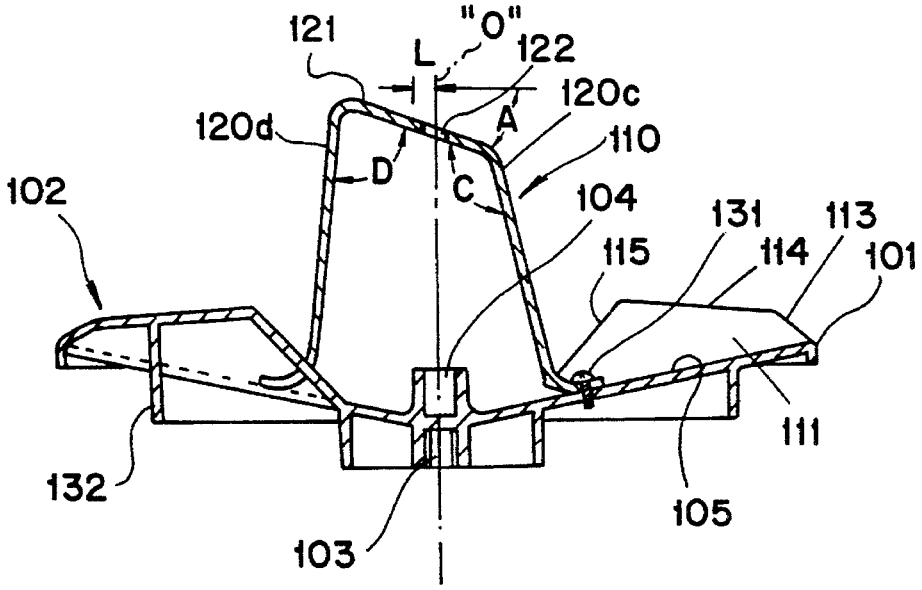
FIG. 4

FIG. 5
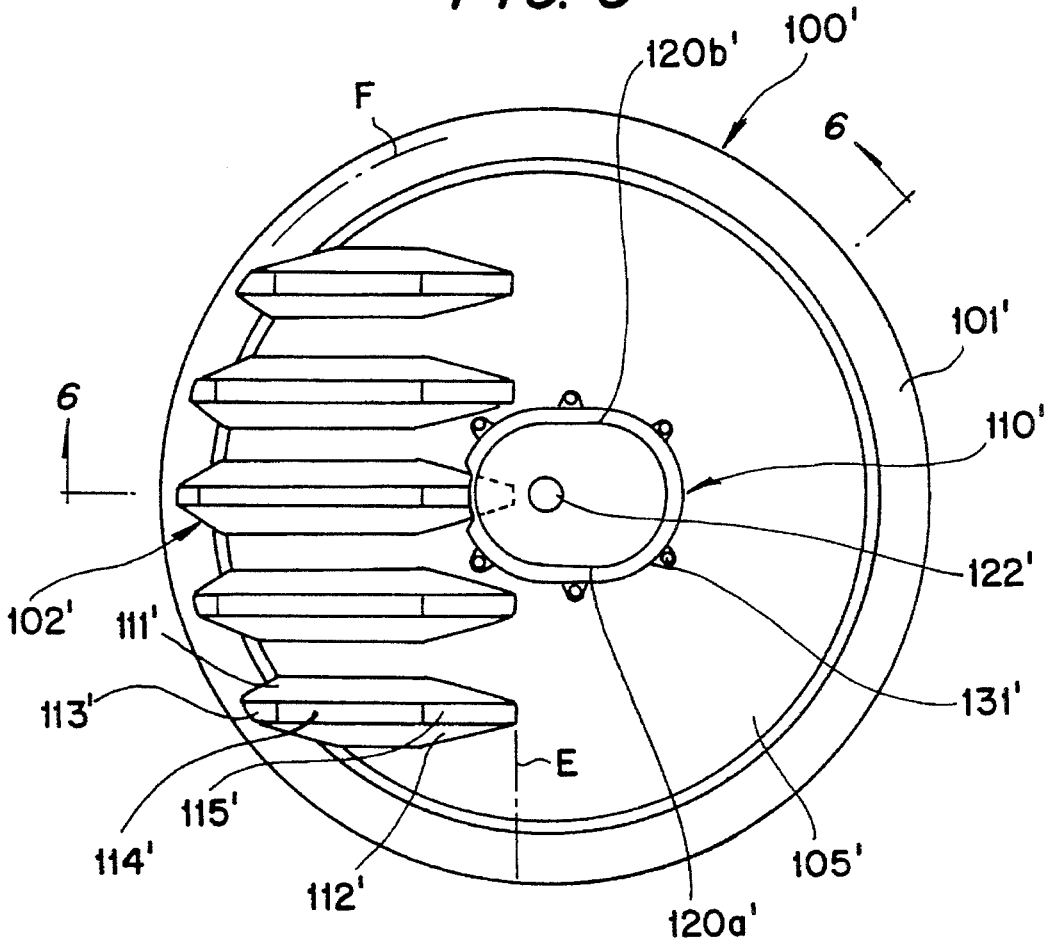
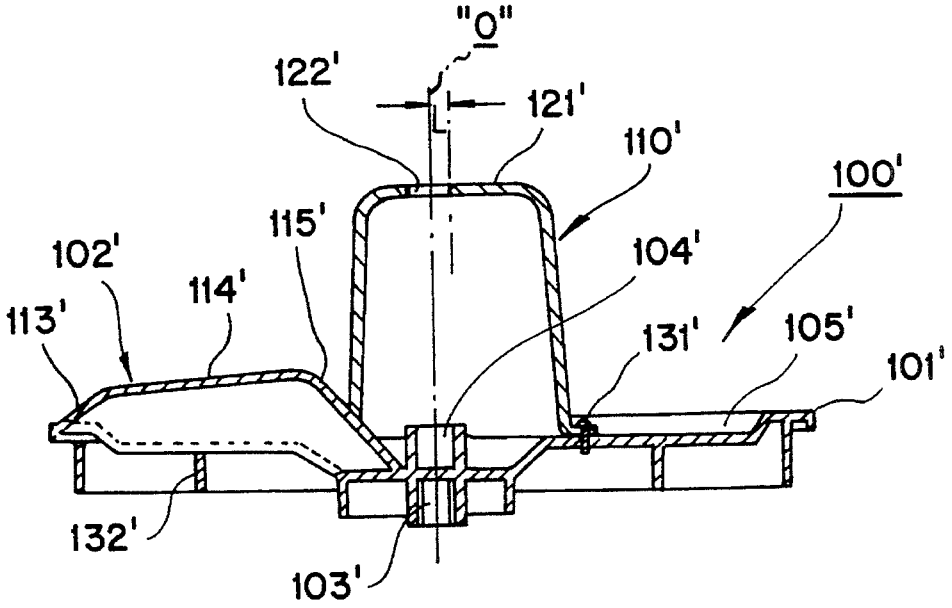
FIG. 6

FIG. 7
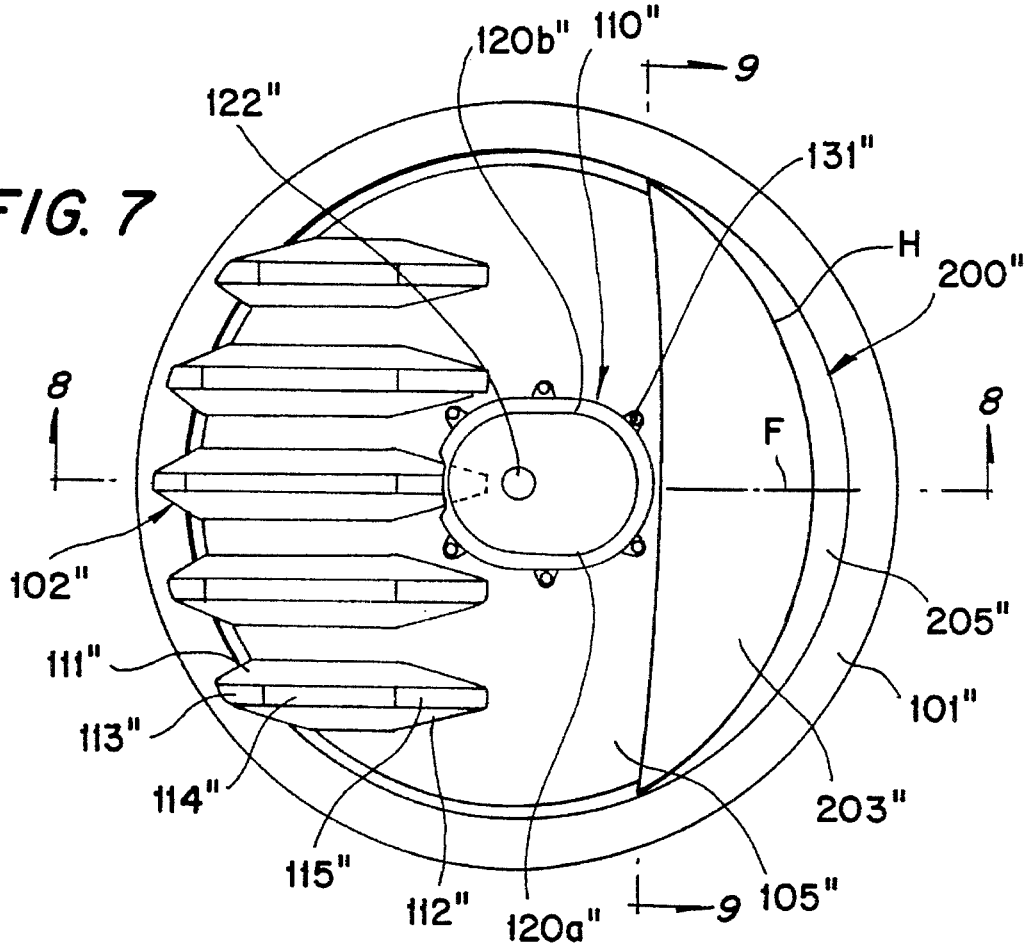
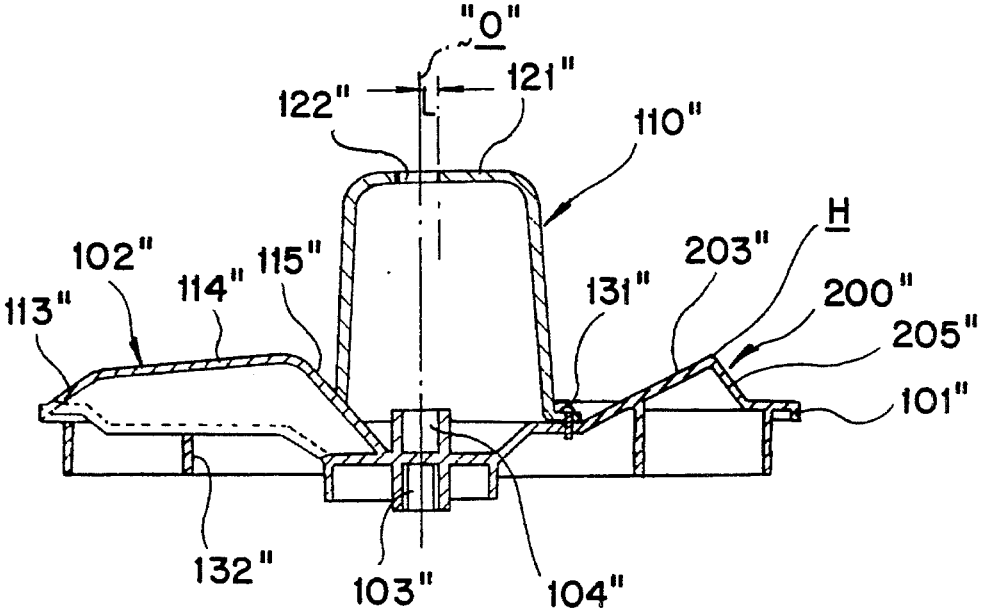
FIG. 8

PULSATOR FOR WASHING MACHINE

BACKGROUND OF THE INVENTION

1. Field of the Invention

The present invention relates a pulsator for a washing machine, and more particularly to a pulsator for a washing machine which is improved in its structure to enhance washability and to prevent material of items from being tangled.

2. Description of the Prior Art

A conventional washing machine includes a rotating basket with a pulsator at its bottom which is adapted to cause washing water to be whirled to agitate items being washed.

However, since the above-mentioned washing machine carries out washing only by a water vortex caused by the pulsator, the washing machine has drawbacks in that a wash item such as cloth is severely twisted thereby to be damaged easily and is not washed evenly thereby causing washing efficiency to be lowered.

A technique for overcoming the above drawbacks is disclosed in Korean Patent Publication No. 88-2734 (entitled "pulsating device for a washing machine"). A sectional view of an embodiment of a washer incorporating the above pulsating device is shown in FIG. 1.

As shown in the drawing, an outer case 1 is provided therein with a tub 3 suspended by an elastic suspension mechanism and also is provided under the tub 3 with a motor 4, a transmission assembly and a belt transmission mechanism 6.

The tub 3 is provided therein with a rotating basket 7 for washing and spin drying wash items, and the rotating basket is provided at its bottom with a pulsator 8.

The rotating basket 7 is connected to a driving shaft 9 of the transmission mechanism 5, and the pulsator 8 is connected to a pulsating shaft (not shown) of the transmission mechanism 5 via a reduction mechanism 10 provided at a bottom of the rotating basket 7.

The transmission mechanism 5 has a clutch mechanism 11 by which a rotating force of the motor 4 is transmitted to the pulsating shaft and the driving shaft 9 or is cut off to rotate the pulsator 8 in a washing mode and to rotate the rotating basket 7 together with the pulsator 8 in a spin-dry mode. The pulsator 8 is adapted to repeat forward and reverse rotation, for example, the pulsator is rotated forwardly at 3 turns and then reversely rotated 3 turns and the procedure is repeated.

Referring to FIG. 2, there is shown a plan view of the pulsator. As shown in FIGS. 1 and 2, a base disk portion 12 is constructed as having a disk shape covering a substantial bottom area of the rotating basket 7 and is provided at its upper surface with four blade portions 13 extended radially and upward. Provided at the center portion of the base disk portion 12 is a center post portion 14 which protrudes upward beyond the blade portions 13.

The center post portion 14 is provided at its upper end with a shaft connecting portion 15 aligned with the center of base disk portion 12, and the shaft connecting portion 15 is connected to an output shaft 10*a* of the reduction mechanism 10.

As again shown in FIG. 2, the center post portion 14 has an elliptic shape in horizontal section the center of which is eccentrically positioned from the rotating center of the base disk portion 12 (the center of the shaft connecting portion 15).

The above-constructed pulsating device for a washing machine can enhance with complexity of the agitated water current as compared with a conventional vortex thereby to increase washing efficiency and also can carry out a shaking wash, a rubbing wash, a pressing wash and reverse of cloth by means of a force of the center post. Accordingly, the device can enhance agitating efficiency and washing efficiency.

However, although the above pulsating device for a washing machine may enhance washing efficiency, it has a limited ability for increasing the complexity of water current and thus a limited ability for increasing washing efficiency. That is, when the amount of the above-mentioned eccentricity of the center post 14 is too much, a load applied to the motor is increased. Conversely, when the amount of eccentricity is to small, water current is simplified (less complex) thereby decreasing washing efficiency.

SUMMARY OF THE INVENTION

Therefore, the present invention is made in view of the above-described prior art problems and an object of the invention is to provide an improved pulsator for a washing machine which can generate a complex water current to enhance washing efficiency and can prevent damage of cloth items due to tangling of the cloth.

In accordance with an embodiment of the present invention, the above object of the invention can be accomplished by providing a pulsator for a washing machine comprising: a base member rotatably mounted in a rotating basket; a plurality of agitating blades protruded upward from the base member; and an agitating post eccentrically positioned from the center of the base member and protruded upward beyond the agitating blades, the agitating post having an upper inclined surface.

In accordance with another embodiment of the invention, the above object of the invention can be accomplished by providing a pulsator for a washing machine comprising: a base member rotatably mounted in a rotating basket; an agitating post eccentrically positioned from the center of the base member and protruded upward; and a plurality of agitating blades parallel to a line connecting the center of the base member to the center of the agitating post and positioned on a half of the base member, the blades being protruded upward.

BRIEF DESCRIPTION OF THE DRAWINGS

These and other objects and aspects of the invention will become apparent from the following description of an embodiment with reference to the accompanying drawings in which:

FIG. 3 is a plan view of a pulsator according to a first embodiment of the present invention;

FIG. 4 is a sectional view taken along lines 4—4 of FIG. 3;

FIG. 5 is a plan view of a pulsator according to a second embodiment of the present invention;

FIG. 6 is a sectional view taken along lines 6—6 of FIG. 5;

FIG. 7 is a plan view of a pulsator according to a third embodiment of the present invention;

FIG. 8 is a sectional view taken along line 8—8 of FIG. 7; and

DETAILED DESCRIPTION OF THE PREFERRED EMBODIMENTS

Figure 1:
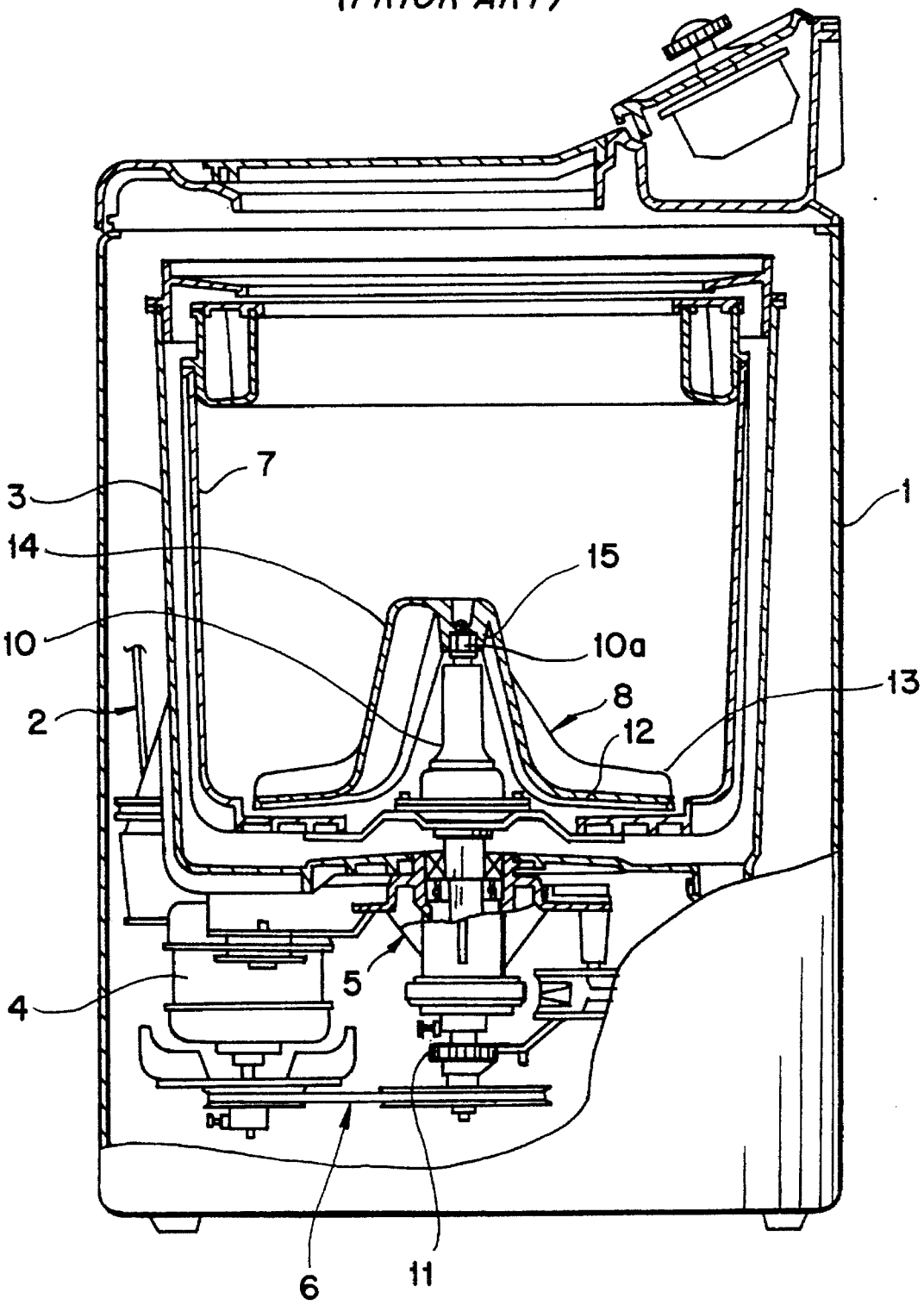
FIG. 1 (PRIOR ART)
FIG. 1 is a vertical sectional view of a washing and dehydrating machine incorporating a conventional pulsator.
Figure 2:
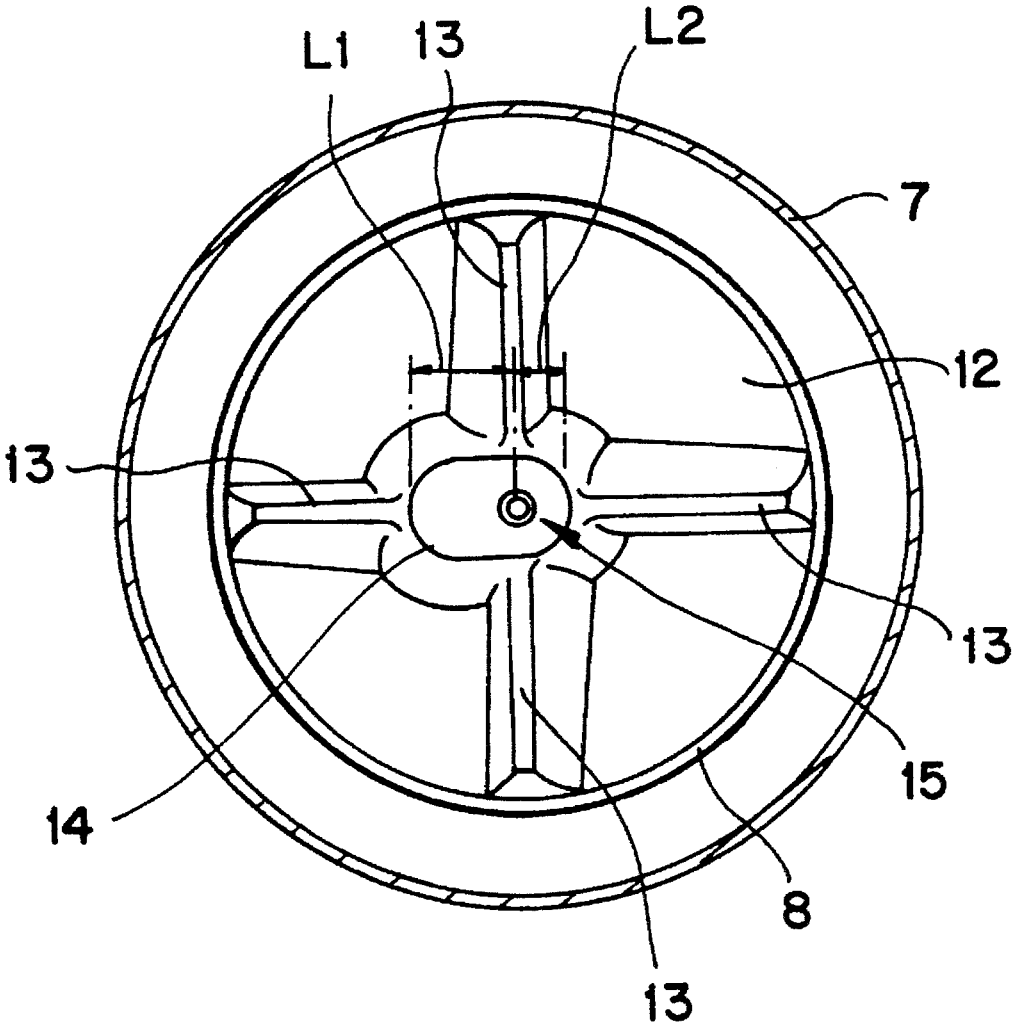
FIG. 2 (PRIOR ART)
FIG. 2 is a plan view of a rotating basket and the pulsator of FIG. 1.

The present invention will now be described in detail by referring to the accompanying drawings hereinafter.

First Embodiment

FIG. 3 is a plan view showing a first embodiment of a pulsator for a washing machine according to the present invention and FIG. 4 is a sectional view taken along lines 4—4 of FIG. 3.

With reference to the drawings, the pulsator 100 according to the invention comprises a base disk 101 forming a base member for the pulsator, a plurality of agitating blades 102 protruded upward from the base disk 101, and an agitating post 110 having an elliptic shape in horizontal section and an upper inclined surface the center of which is eccentrically positioned from a rotating center "O" of the base disk 101 and protruded upward beyond the agitating blades 102.

In this embodiment, the base disk 101 is concave downward at its center portion. That is, the base disk 101 is inclined down to its center so a the plurality of recesses 105 for containing water are defined by the base disk 101 and the agitating blades 102. A reinforcing cylindrical rib 132 is formed at lower surfaces of the base disk 101 and the agitating blades 102.

Each of the agitating blades 102 is radially extended and protruded upward from the upper surface of the base disk 101 and has first and second slopes 111 and 112 forming both of its sides and third, fourth and fifth slopes 113, 114 and 115 forming its outer, top and inner edges.

The first and second slopes 111 and 112 have predetermined inclined angles with respect to vertical central planes of the agitating blades 102. The fourth slope 114 is located at a middle portion of the upper edge of the agitating blade 102 and is slightly inclined down to the outside. The third and fifth slopes 113 and 115 are inclined down to the outside and inside respectively and have predetermined inclined angles.

The agitating post 110 is constructed such that its center is eccentrically positioned from the rotating center "O" of the pulsator 100 by a predetermined distance "L", and its upper surface 121 has a rectangular or elliptic shape and a predetermined inclined angle A (0°–75°). In this embodiment, the upper surface 121 is inclined down from the center of the post 110 to the rotating center of the agitator 100.

The agitating post 110 is formed at its upper end with a coupling hole 122 such that the center of the coupling hole 122 is aligned with the center of the base disk 101. The coupling hole 122 is adapted to couple the pulsator 100 to a driving shaft (not shown) by means of coupling member inserted therein.

The base disk 101 is provided beneath its center potion with a fitting hole 103 in which the driving shaft for transmitting rotating force of the motor to the pulsator 100 is fitted and is provided on its center portion with a coupling hole 104 in which a coupling member (not shown) is inserted. The agitating post 110 is formed at its lower flange portion with a plurality of coupling holes 130 for coupling the agitating post 110 to the base disk 101, and is cut out at positions corresponding to inner ends of the agitating blades 102.

Alternatively, the agitating blades 102 may be constructed such that inner ends of the blades are not overlapped with the agitating post 110, and also the agitating blades 102 may be cut out at portions overlapped with the agitating post 110. The agitating post 110 is tightly secured to the base disk 101 by means of coupling members 131.

In this embodiment, although the agitating post 110 is described as being coupled to the base disk 101 by means of coupling members, the agitating post 110 may be integrally formed with the base disk 101. In this instance, the fitting hole 103 is extended to the upper surface 121 of the agitating post 110 so that the pulsator 100 can be coupled to the driving shaft (not shown).

Operation of the pulsator for a washing machine according to the embodiment of the invention will be described hereinafter.

Upon operating the clutch, driving force of the motor is transmitted to the pulsator, thereby causing the pulsator to be rotated forwardly and reversely. As the pulsator 100 is rotated forwardly and reversely, washing water and wash items are driven upward by the first and second slopes 111 and 112 of the agitating blades 102. The washing water and the wash items agitated by the first and second slopes 111 and 112 are dispersed upwardly along the first and second slopes 111 and 112, thereby generating a vortex in the water.

At this time, the washing water and the wash items are driven and dispersed by centrifugal force. Since the agitating blades 102 have the main top slopes 113, 114 slightly inclined down to the radial outside, the washing water and the wash items are more efficiently dispersed outward. Therefore, the washing water and the wash items are raised along a side wall of the rotating basket 7 (see FIG. 1). At the same time, the washing water and the wash items are also dashed and driven by side slopes **120*a* and 120*b* of the agitating post 110 eccentrically mounted on the pulsator 100, thereby generating a vortex. Since the side slopes 120*a* and 120*b* of the agitating post 110 are asymmetrically formed with respect to the rotation center "O" of the base disk 101, the rotation of the agitating post 110** causes turbulence of the washing water.

The washing water and the wash items driven upward are lowered above the agitating post 110. At this time, since the upper surface 121 of the agitating post 110 is inclined, the descending water and wash items reach the upper surface 121 with a time difference. Also, the water and the wash items collide against both rounded ridges **120*c*, 120*d* of the agitating post 110** and thus are dispersed outward.

In this instance, since both rounded ridges C, D, respectively, which are of the agitating post 110 have inclined angles different from each other, the water and wash items dispersed from the both rounded ridges have dispersion manners different from each other, so that phenomenon that there occurs a large water current can not be formed (i.e., there occurs a separation of flow). Thus, a large water current pattern about the post can not be formed. Accordingly, the washing water and the wash items are unevenly dispersed toward both sides and thus a cloth-type wash item is not tangled but rather is evenly unfolded.

As described above, since the pulsator for a washing machine does not cause washing water to be whirled concentrically about a certain rotation axis in a manner similar to the prior art but causes complex turbulence of the washing water crossing over a rotation axis and varying in its whirling manner as time passes, by means of the eccentric agitating post having the inclined upper surface, cloth is evenly unfolded and spread, thereby improving washing performance, shortening washing time and preventing cloth from becoming tangled.

By way of suggestion, a principle that turbulence is generated by the agitating post having the inclined upper surface is introduced from the Rossby wave theory. C. G. Rossby is a man who studied geophysics, and proposed the Rossby wave theory in view of the fact that rotation of atmosphere on the earth about the rotation axis is not uniform but continuously varies according to the passage of time because the surface of the earth is inclined with regard to the rotation axis of the earth at all regions besides the polar regions.

The Rossby wave theory is what is proposed by C. G. Rossby, in 1936, and states that when a rotating surface is inclined with regard to the rotation axis by a predetermined angle, fluid does not form symmetrical and concentric rotating current but forms asymmetrical current varying according to the passage of time.

The theory is integrated into a greater whole by H. P. Greenspan, a professor of the department of applied mathematics of M.I.T. who is an authority in the field of rotating current theory, and thus is settled as an indispensable theory with regard to rotating current.

Second Embodiment

FIG. 5 is a plan view showing another embodiment of a pulsator for a washing machine according to the present invention and FIG. 6 is a sectional view taken along lines 6—6 of FIG. 5.

With reference to the drawings, the pulsator 100' according to the invention comprises a base disk 101' forming a base member for the pulsator, a plurality of parallel agitating blades 102' protruded upward from a half of the base disk 101', and an agitating post 110' having an elliptic shape in horizontal section the center of which is eccentrically positioned from a rotating center "O" of the base disk 101' and protruded upward beyond the agitating blades 102'.

In this embodiment, the base disk 101' is a circular plate and is concave downward at its center. That is, the base disk 101' is protruded upward at its outer periphery to form a recess 105' for containing washing water. A reinforcing cylindrical rib 132' is also formed at lower surfaces of the base disk 101' and the agitating blades 102.

The agitating blades 102' are provided on a half of the base disk 101', that is, a left half opposite to a right half of the base disk 101' (with reference to FIG. 5), the dividing line for the halves being where the center of the agitating post 110' is located. Inner ends of the agitating blades 102' lie on a straight line and the outer ends lie on a circumferential line F. Accordingly, as one goes from the middle blade to an outer blade, the agitating blade 102' is continuously reduced in its length. The middle blade lies along radius of the agitator, which radius bisects one half of the agitator. The remaining blades extend parallel to the middle blade.

Each of the agitating blades 102' has first and second slopes 111' and 112' forming both sides and third, fourth and fifth slopes 113', 114' and 115' forming its outer, top and inner edges.

The first and second slopes 111' and 112' have predetermined inclined angles with respect to vertical central planes of the agitating blades 102'. The fourth slope 114' is located at a middle portion of the upper edge of the agitating blade 102' and is slightly inclined down to the outside. The third and fifth slopes 113' and 115' are inclined down to the outside and inside respectively and have predetermined inclined angles.

The agitating post 110' is constructed such that its center is eccentrically positioned from the rotating center "O" of the pulsator 100' by a predetermined distance "L", and its upper surface 121' has a rectangular or elliptic shape.

The agitating post 110' is formed at its upper end with a coupling hole 122' such that the center of the coupling hole 122' is aligned with the center of the base disk 101'. The coupling hole 122' is adapted to couple the pulsator 100' to a driving shaft (not shown) by means of coupling member inserted therein.

The base disk 101' is provided beneath its center potion with a fitting hole 103' in which the driving shaft for transmitting rotating force of the motor to the pulsator 100' is fitted and is provided on its center portion with a coupling hole 104' in which a coupling member (not shown) is inserted. The agitating post 110' is coupled to the base disk 101' by means of a plurality of coupling members 131', and is cut out at a portion 110A overlapped with an inner end of the middle agitating blade 102'.

Alternatively, the middle agitating blade 102' may be constructed such that inner end of the blade is not overlapped with the agitating post 110', or the inner and of the middle agitating blade 102' may be cut out.

In this embodiment, although the agitating post 110' is described as being coupled to the base disk 101' by means of coupling members, the agitating post 110' may be integrally formed with the base disk 101'. In this instance, the fitting hole 103' is extended to the upper surface 121' of the agitating post 110' so that the pulsator 100' can be coupled to the driving shaft (not shown).

Operation of the pulsator for a washing machine according to the second embodiment of the invention will be described hereinafter.

Upon operating the clutch, driving force of the motor is transmitted to the pulsator, thereby causing the pulsator to be rotated forwardly and reversely. As the pulsator 100' is rotated forwardly and reversely, washing water and cloth items are driven upward by the first and second slopes 111' and 112' of the agitating blades 102'. The washing water and the cloth agitated by the first and second slopes 111' and 112' are dispersed along the first and second slopes 111' and 112', thereby generating a vortex in the water.

The washing water and the cloth disposed above the other half of the base disk 101' on which the agitating blades 102' are not provided are lightly rubbed by the pulsator 100'. Some of the water and cloth collide with both side slopes 120*a'* and 120*b'* of the agitating post while some of the water and cloth collide not head-on but obliquely with the first and second slopes 111' and 112' of the agitating blades 102' to be dispersed outward. Accordingly, the wash items are washed by a beating action and a rubbing action and are disposed upward and turbulence is generated in the washing water. That is, a complex current is generated above the base disk 101' by the half of the base disk 101' on which the agitating blades 102' are provided, by the other half of the base disk, and by the eccentric agitating post 110'.

Therefore, the washing water and the wash items are raised along a side wall of the rotating basket 7 (see FIG. 1) and then lowered above the agitating post 110'. The lowering washing water and wash items collide with the outer circumference of the upper surface 121' of the post 110' and dispersed outward. The outer dispersion is not uniform due to the complex current. Accordingly, the washing water and the wash items are unevenly dispersed toward both sides and thus the wash items are not tangled but evenly unfolded.

As described above, since the pulsator for a washing machine according to the second embodiment does not cause washing water to be whirled concentrically about a certain rotation axis in a manner similar to the prior art but causes complex turbulence of the washing water varying in its whirling manner as time passes by means of the eccentric agitating post and the blades, a cloth item is evenly unfolded and spread, thereby improving washing performance, shortening washing time and preventing tangle of cloth.

Third Embodiment

Figure 9:
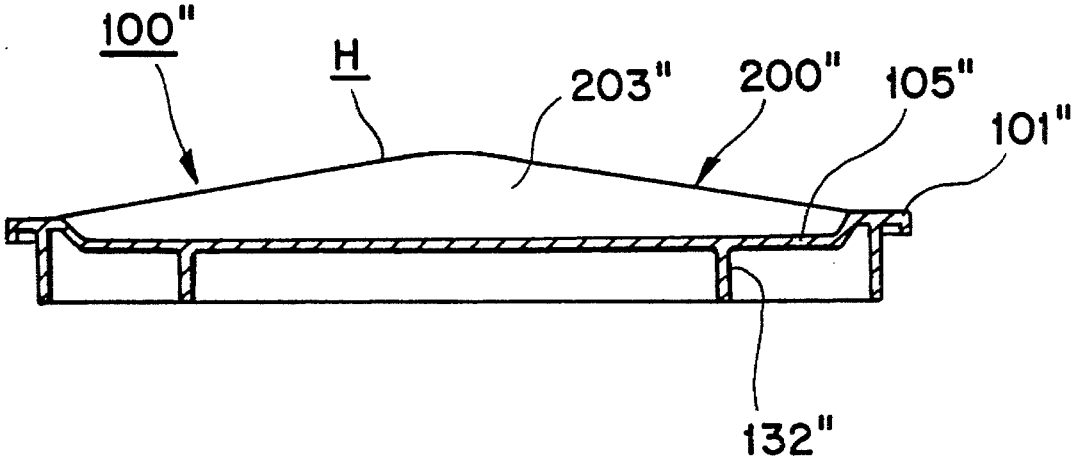
FIG. 9 is a sectional view taken along lines 9—9 of FIG. 7.

FIG. 7 is a plan view showing still another embodiment of a pulsator for a washing machine according to the present invention, FIG. 8 is a sectional view taken along line 8—8 of FIG. 7 and FIG. 9 is a sectional view taken along line 9—9 of FIG. 7.

As shown in the drawings, the third embodiment of the invention is different from the second embodiment in that a base disk 101' forming a base member of the pulsator has a crescent-shaped protrusion 200" protruded upward at a periphery of a half of the base disk 101' on which agitating blades 102" are not provided. The protrusion is most high at a point crossed by a major axis F of an elliptic sectional shape of the agitating post 110". From its highest point to both of its sides, the protrusion 200" is continuously lowered. The ridge line "H" of the protrusion 200" defines an arc as viewed from above. Therefore, the protrusion 200" includes a first surface 203" slightly inclined downwardly inwardly from the ridge line H and a second surface 205" inclined downwardly outwardly from the line H.

According to the third embodiment, since an additional complex current is provided by the protrusion 200", the washing water and wash item are more complicatedly dispersed by centrifugal force and are easily raised.

As apparent from the above description, since the pulsator for a washing machine according to the first embodiment of the invention (FIGS. 3 and 4) has the eccentric agitating post with the inclined upper surface to cause complex current, it is possible to increase washing efficiency.

Also, since the pulsator according to the second and third embodiments of the invention (FIGS. 5–9) has the agitating blades provided at a half of the base disk and the eccentric agitating post the center of which is positioned at the other half to cause complex current, it is possible to increase washing efficiency.

While the preferred forms of the present invention has been described, it is to be understood that various modification will be apparent to those skilled in the art without departing from the spirit of the invention.

Particularly, although the agitating post has been depicted only as being coupled to the base disk in the above embodiments, it is also capable of achieving the objects of the invention if integrally formed with the base disk.

Also, it will be obvious that various changes in the number, structure and size (height, length and the like) of the agitating blades of the invention may be made.

In the second and third embodiments, although the agitating posts are described only as having an upper horizontal surfaces, it is possible for them to have inclined surfaces similarly to the first embodiment.

What is claimed is:

1. A pulsator for a washing machine, comprising:

a base having a first vertical center axis; the base including a coupling portion coaxial with the first center axis and adapted for connection to a drive shaft to define a vertical axis of rotation coinciding with the first center axis;

a plurality of agitating blades extending upwardly from the base, the blades arranged symmetrically with respect to the first center axis, each of the blades having circumferentially facing sides sloping generally downwardly and outwardly; and an agitating post extending upwardly from a center region of the base beyond the agitating blades, the agitating post having a second vertical center axis arranged eccentrically with respect to the first center axis and including an upper surface inclined relative to horizontal such that a highest point on the upper surface is spaced from points of intersection of the upper surface with the first and second vertical axes, respectively.

2. The pulsator according to claim 1, wherein the upper surface forms an angle to horizontal of up to 75 degrees.

3. The pulsator according to claim 1, wherein the upper surface has a generally elliptical shape as viewed in top plan.

4. The pulsator according to claim 1, wherein the upper surface has a hole formed therethrough to receive a driving shaft.

5. The pulsator according to claim 1, wherein the agitating post is attached to the base by fasteners.

6. The pulsator according to claim 1, wherein the agitating post is of integral one-piece construction with the base.

7. The pulsator according to claim 1, wherein each of the agitating blades extends radially.

8. The pulsator according to claim 1, wherein the post includes an upstanding side wall, the side wall including circumferentially spaced portions inclined at different angles relative to vertical, whereby the side wall is asymmetric relative to the second center axis.

9. The pulsator according to claim 1, wherein a top surface of the base has an outer periphery situated higher than the center region thereof.

10. The pulsator according to claim 1, wherein each agitating blade includes an upper surface, the upper surface including a portion inclined upwardly from an outer periphery of the base, a middle portion inclined slightly upwardly toward the post, and an inner portion inclined downwardly to the post.

11. The pulsator according to claim 1, wherein the upper surface of the post includes a first portion disposed higher than an opposite portion of the upper surface.

* * * * *